US006641244B2

(12) United States Patent
Dougherty et al.

(10) Patent No.: US 6,641,244 B2
(45) Date of Patent: Nov. 4, 2003

(54) METHOD AND APPARATUS FOR MODIFYING A PRINTING PROCESS IN RESPONSE TO ENVIRONMENTAL CONDITIONS RECEIVED VIA A NETWORK

(75) Inventors: Patrick S. Dougherty, Boise, ID (US); Santiago Rodriguez, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 133 days.

(21) Appl. No.: 09/994,636

(22) Filed: Nov. 28, 2001

(65) Prior Publication Data

US 2003/0101017 A1 May 29, 2003

(51) Int. Cl.[7] ..... B41J 29/393; B41J 29/38
(52) U.S. Cl. ..... 347/19; 347/14
(58) Field of Search ..... 347/19, 14, 12, 347/5, 4, 3, 17, 10–11, 2, 43, 16, 15; 399/27, 44; 400/74, 279, 322, 323

(56) References Cited

U.S. PATENT DOCUMENTS 5,617,122 A * 4/1997 Numata et al. ..... 347/14

* cited by examiner

*Primary Examiner*—Stephen D. Meier
*Assistant Examiner*—Charles W. Stewart, Jr.

(57) ABSTRACT

A method, a computer readable medium and an apparatus for modifying a printing process in response to an environmental condition received via a network. In the method, the environmental condition is received via the network and the printing process is modified in response to the environmental condition. In the computer readable medium, software embedded in the medium includes executable code to perform the above mentioned method. In the apparatus, a printing device is configured to apply a colorant to a print medium and a controller is configured to modify the printing device based on the environmental condition received via the network.

12 Claims, 4 Drawing Sheets

METHOD AND APPARATUS FOR MODIFYING A PRINTING PROCESS IN RESPONSE TO ENVIRONMENTAL CONDITIONS RECEIVED VIA A NETWORK

FIELD OF THE INVENTION

This invention relates generally to printing, and more particularly to modifying a printing process in response to environmental conditions received via a network.

BACKGROUND OF THE INVENTION

It is widely known that environmental conditions (e.g., temperature, relative humidity, barometric pressure, etc.) may impact various aspects of the printing process. Generally, the printing process involves the application of a colorant (e.g., ink, toner, etc.) onto a print medium. For example, in inkjet printers, dry air (i.e., low relative humidity) may exacerbate pen decap. In another example, in electrophotographic ("EP") printers (e.g., laser printers, etc.), cold and/or dry air may affect toner transfer and thus, image quality and toner usage. Additionally, environmental conditions ("ECs") may affect estimation of toner usage in EP printers.

To address the impact of ECs on the printing process, various conventional printing devices have sought to optimize the printing process for so-called "typical" ECs. However, as printing technology has improved, pixel size has generally been reduced. Along with this reduction in pixel size, a corresponding increase in the impact of ECs has occurred. For example, to decrease pixel size, toner particle size has decreased. In general, smaller particles may be more susceptible to fluctuations in electrostatic charge due to ECs which may lead to unacceptable print quality. Thus, the image quality of these conventional printing devices may only be acceptable for a relatively narrow range of ECs.

Additionally, some conventional printing devices modify certain printing processes by utilizing sensors to measure ECs in the vicinity of the printer. For example, U.S. Pat. No. 5,655,174, currently assigned to HEWLETT-PACKARD COMPANY, discloses a printing system including an ambient condition sensor for estimating the consumption of toner, the disclosure of which is hereby incorporated by reference in its entirety.

While a variety of methods exist to measure ECs, generally, each environmental condition ("EC") or environmental factor ("EF") requires a separate sensor. For example, relative humidity ("RH") may be measured by Dunmore cells, Pope cells, and thin-rim capacitance meters. However, RH sensors are generally incapable of measuring temperature or barometric pressure. To measure temperature, typically a thermocouple or thermistor is utilized. To measure barometric pressure, typically a pressure transducer is utilized. Thus, to measure RH, temperature and barometric pressure, three sensors and their associated electrical components may be required. Each sensor added to a printer, or any other device, increases the cost and complexity of the printer or device.

SUMMARY OF THE INVENTION

In one respect, the invention pertains to a method for modifying a printing process in response to environmental conditions received via a network. In the method, an environmental condition measurement is received via a network and a printing process is modified in response to the environmental condition.

In another respect, the invention pertains to a computer readable medium on which is embedded computer software. The software includes executable code to perform a method for modifying a printing process in response to environmental conditions received via a network. In the method, an environmental condition measurement is received via a network and a printing process is modified in response to the environmental condition.

In yet another respect, the invention pertains to an apparatus for modifying a printing process in response to environmental conditions received via a network. The apparatus includes a printing device configured to apply a colorant to a print medium and a controller configured to modify the printing device based on an environmental condition measurement received via a network.

In comparison to known prior art, certain embodiments of the invention are capable of achieving certain aspects, including some or all of the following: (1) improve image quality; (2) improve toner usage estimation; (3) decrease cost by reducing the number of parts in the printer; and (4) increase reliability by reducing the number of parts in the printer. Those skilled in the art will appreciate these and other aspects of various embodiments of the invention upon reading the following detailed description of a preferred embodiment with reference to the below-listed drawings.

DETAILED DESCRIPTION OF A PREFERRED EMBODIMENT

For simplicity and illustrative purposes, the principles of the invention are described by referring mainly to an exemplary embodiment thereof, particularly with references to a system to measure the temperature and/or RH via a network. However, one of ordinary skill in the art would readily recognize that the same principles are equally applicable to, and may be implemented in, a system capable of remotely determining and forwarding any environmental condition to any device, and that any such variations are within the scope of the invention. While in the following description numerous specific details are set forth in order to provide a thorough understanding of an embodiment of the invention, in other instances, well known methods and structures have not been described in detail so as not to obscure the invention. Furthermore, the terms "connected" and its variants, as used herein, mean connected directly or indirectly through an intermediary element.

Figure 1:
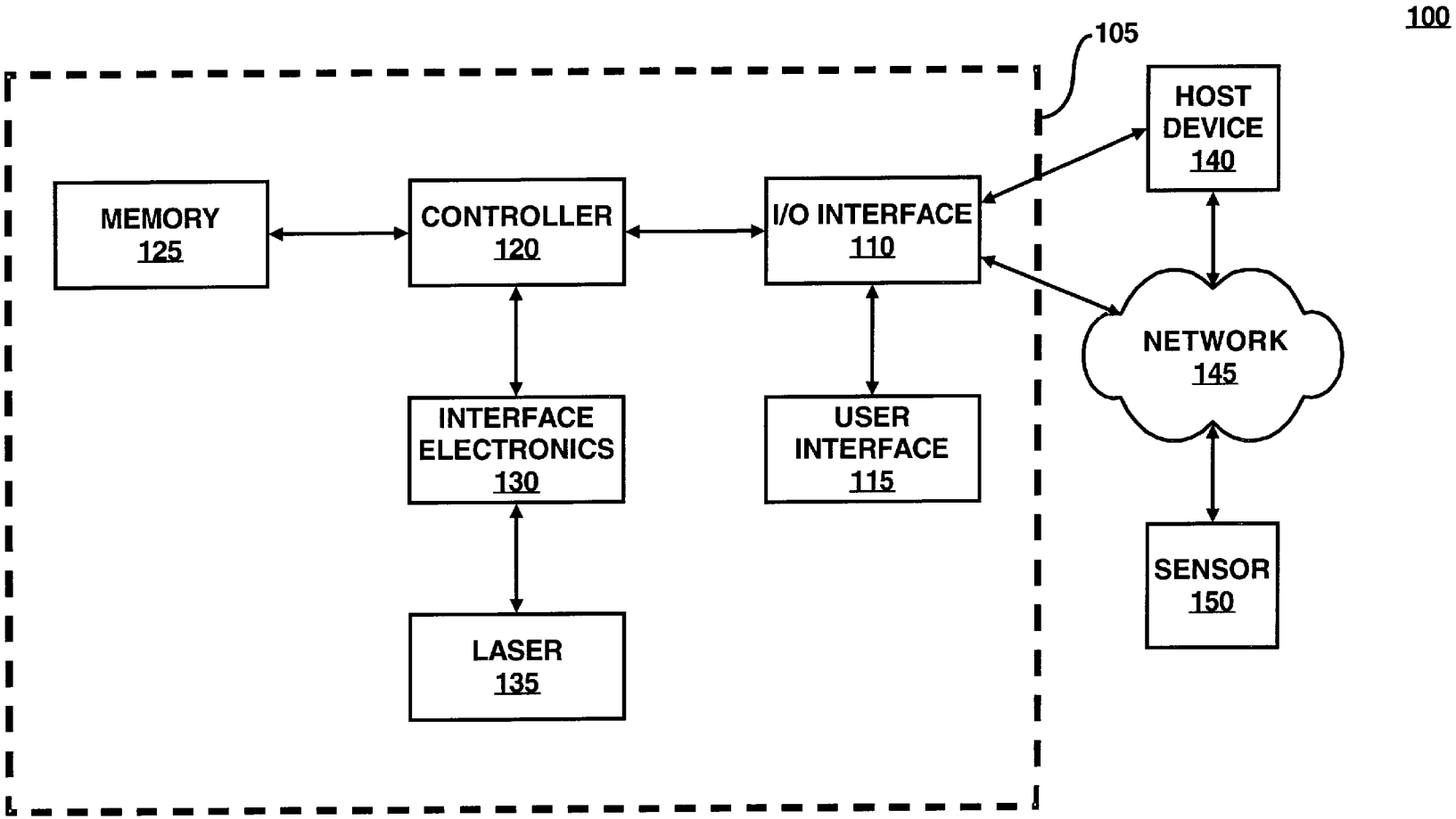
FIG. 1 is a block diagram of a system according to an embodiment of the invention.

FIG. 1 is a block diagram of a system 100 according to an embodiment of the invention. The system 100 generally illustrates components of a printer 105 and various components that may interact with the printer 105. As shown in FIG. 1, the printer 105 may include an input/output ("I/O") interface 110, a user interface 115, a controller 120, a memory 125, an interface electronics 130 and a laser 135. Typically, a print job may be sent by a host device 140 (e.g., a computer, server, workstation, and the like) and received by the I/O interface 110, however, as is known to those skilled in the art, the functionality of the host device 140 may be subsumed within the printer 105 e.g., an electronic typewriter, a copier, etc.

In a manner similar to known printing devices, the I/O interface 110 may be configured to receive the print job and forward the print job to the controller 120. The I/O interface 110 may further be configured to send and/or receive information to/from the user interface 115 and to send and/or receive information to/from a network 145. In this regard, the I/O interface 110 may conform to protocols such as RS-232, parallel, small computer system interface, universal serial bus, transmission control protocol over Internet protocol, etc.

The user interface 115 may be configured to perform, at least, the functions of a known user interface. For example, the user interface 115 may be configured to display information and provide the capability for a user to enter information. The information may include print mode, print medium source, print medium type, various information associated with printer location, etc. With regard to the various information associated with printer location, the user interface may prompt the user as to whether the printer is inside an office building, whether the windows are open, etc. Alternatively, some or all of the functionality of the user interface may be subsumed within the host device 140.

The controller 120 may be configured to provide control logic for the printer 105, which provides the functionality for the printer. In this respect, the controller 120 may possess a microprocessor, a micro-controller, an application specific integrated circuit, and the like. The controller 120 may be interfaced with the memory 125 configured to provide storage of a computer software that provides the functionality of the printer 105 and may be executed by the controller 120. The memory 125 may also be configured to provide a temporary storage area for data/file received by the printer 105 from the host device 140. The memory 125 may be implemented as a combination of volatile and non-volatile memory, such as dynamic random access memory ("RAM"), EEPROM, flash memory, and the like. It is also within the purview of the present invention that the memory 125 may be included in the host device 140.

Additionally, the controller 120 may be connected to and configured to control the interface electronics 130. The interface electronics 130 may be configured to modulate the laser 135 during scans across the surface of an optical photoreceptor (not shown) or similar device in a manner known to those skilled in the art. Furthermore, the controller 120 may modify commands sent to the interface electronics 130 based on data associated with the ECs. Moreover, although not illustrated in FIG. 1, the controller 120 may be connected to and configured to control a multitude of other well known systems within the printer 105 (e.g., a developer, a print roller, an intermediate transfer belt ("ITB"), etc.).

The controller 120 may further be connected to and configured to control the I/O interface 110. In this regard, the controller 120 may be operable as an imbedded Web server ("IWS") and capable of being configured to search for information via various types of networks (e.g., the Internet, a local area network, an intranet, etc.). Thus, for example, the controller 120 may be configured to find and poll one or more sensors in the vicinity of the printer 105.

In one form, the network 145 may be a local area network ("LAN"). Although not illustrated, in a manner similar to know LANs, the network 145 may connect various components to one another. In this regard, a sensor 150 may be connected to the network 145. The sensor 150 may include multiple sensors and be operable to sense a plurality of ECs. The sensor 150 may be configured to relay data associated with the ECs to the printer 105 and various other components connected to the network 145. For example, the printer 105 may be located within a building (not shown). The building may include a heating, ventilation, air conditioning ("HVAC") system (not shown) configured to control the ECs within the building. The HVAC system may include the sensor 150. The HVAC system and/or the sensor 150 may be configured to communicate to the network 145.

In another form, the network 145 may be the Internet and the controller 120 may be configured to receive the ECs for the general vicinity of the printer 105 from a Web page. For example, the Web page accessed at the uniform resource locator ("URL") address, "http://www.weather.com" includes measurements of temperature, UV Index, wind speed and direction, dew point, RH, visibility and barometric pressure. This information may be accessed for essentially any location in the United States of America by entering a zip code for the location.

While data associated with the ECs may be utilized to modify a variety of EP processes, one particular EP process that may be modified is toner estimation. To accurately estimate toner usage, a pixel and/or a pulse width count ("PWC") may be accumulated. The PWC is a measure of the accumulated width of pulses. It is a phenomenon of the EP process that, for a given pixel count and/or PWC, varying the environment in which a printer is located results in a non-linear amount of toner transfer. While pixel count, PWC and a variety of other values (e.g., half tone level, etc.) may be influenced by a variety of ECs, in the following relatively simplified description, estimating toner usage in response to pixel count and RH will be described. For example, and as illustrated by an exemplary graph in FIG. 4, toner usage per pixel is altered as a function of RH. Additionally, various other methods of estimating toner usage (e.g., determining half tone level and the like) are known to those skilled in the art and are within the purview of the invention. Accordingly, the description of pixel count to determine toner usage is but one manner in which various embodiments of the invention may be utilized and is not meant to limit the invention in any way.

Figure 2:
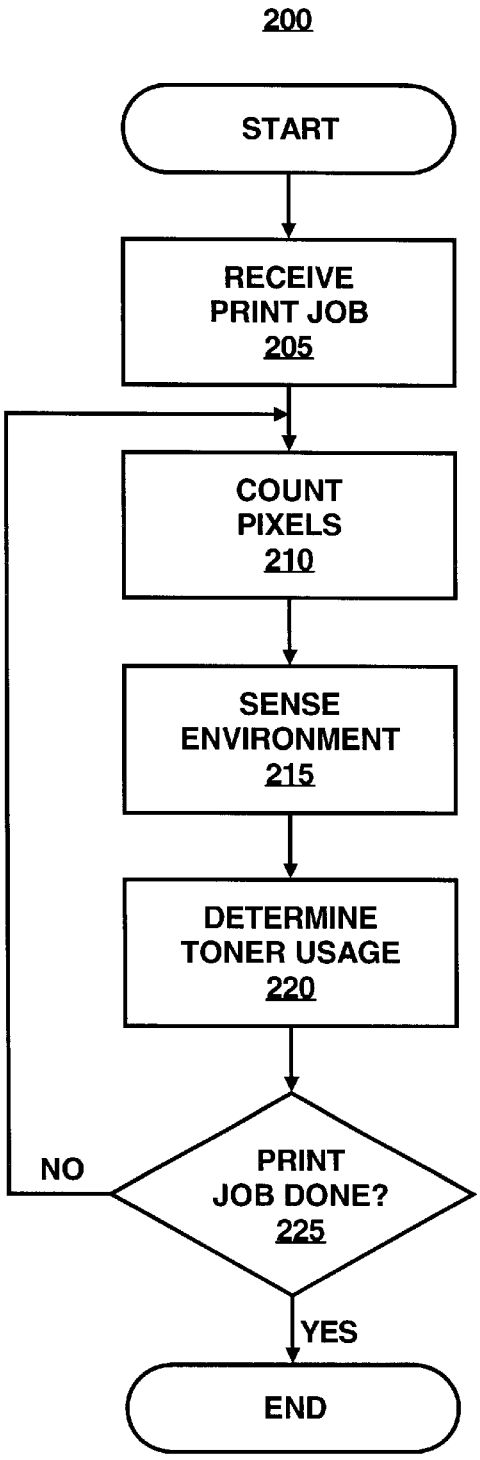
FIG. 2 is a flow chart of a method according to an embodiment of the invention.

FIG. 2 is a flow chart of a method 200 in accordance with a manner in which an embodiment of the invention may be practiced. As depicted in FIG. 2, the method 200 is initiated in response to receiving a print job in step 205.

In step 210, the pixel count may be determined based on the print job or corresponding printer specific commands generated in response to the print job. The pixel count may be determined at the time the printjob is generated, after the print job has finished printing, and/or any time in between. In a preferred form, a pixel count may be accumulated for each page of the print job. The pixel count for each scanned line may be determined as the scanned line is being produced. An accumulated pixel count value for each page may be determined in a variety of ways, such as by adding all of the pixels or values of the scanned lines within the page. Similarly, a pixel count for the print job and/or usable lifespan of the toner cartridge may be determined.

In step 215, one or more ECs may be measured by the sensor 150 and received by the printer 105 as described in FIG. 1. In various forms, the EC(s) may be measured before the print job is generated, after the print job has finished printing, and/or any time in between. Accordingly, the steps 210 and 215 need not be performed in the order as shown in FIG. 2, but rather, the steps 210 and 215 may be performed in the opposite order or simultaneously. In a preferred form, the EC(s) may be measured just prior to and/or while printing the print job. For example, the EC(s) may be measured by the sensor 150 as the printer 105 is preparing to print the first page and/or as each page of the print job is being produced. However, it may be preferable that the printer 105 not wait an excessive amount of time (e.g., 20 seconds and the like) for data associated with the EC(s) from the sensor 150. In this regard, the controller 120 may reference a value previously stored to the memory 125 for example. The previously stored value may correspond to the most recent measurement of the EC(s). In one form, the previously stored value may be updated periodically (e.g., every hour, etc.) while the printer 105 is active and connected to the network 145.

In step 220, the method 200 may determine the toner usage. The EC(s) may be utilized to determine the toner usage for each pixel, scan line, page, print job and/or the usable lifespan of the toner cartridge. In a preferred form, the toner usage value for each page may be determined by referencing the pixel count and the EC(s) for the page and applying these values to a look up table ("LUT"), such as, the LUT disclosed in U.S. Pat. No. 5,793,406, currently assigned to HEWLETT-PACKARD COMPANY, the disclosure of which is hereby incorporated by reference in its entirety. Additionally or instead of the LUT, a statistical regression equation ("SRE") substantially the same as the SRE used to generate the LUT may be used to determine the toner usage without departing from the scope of the invention. In general, the LUT may be thought of as a predetermined or static SRE that is less resource intensive than the SRE but less capable of adjustability. A combination of LUT and SRE may be incorporated in such a way as to utilize the LUT for common ECs, thus saving system resources and increasing print speed. The SRE may be utilized for uncommon ECs to increase accuracy of toner estimation. Moreover, the SRE and/or the LUT may take into account the following factors: system design, toner chemistry, optical photoreceptor ("OPR") sensitivity, PWC, pulse edge count, associated half tone level, pixel count, EC(s), empirical data, etc. After determining the toner usage, the value may be stored within memory. A toner remaining value may be determined as well. For example, based on a predetermined starting amount of toner and the toner usage, the toner remaining may be calculated. Furthermore, PWC, EC(s), toner remaining, and pixel count values may be stored within the memory 125.

In step 225, it may be determined if the method 200 has reached the end of the print job or the corresponding printer specific commands generated in response to the print job. For example, if an end of file marker is encountered, the method 200 may terminate. If it is determined that the end of the print job or the corresponding printer specific commands generated in response to the print job has not been reached, the method 200 may return to step 210.

Figure 3:
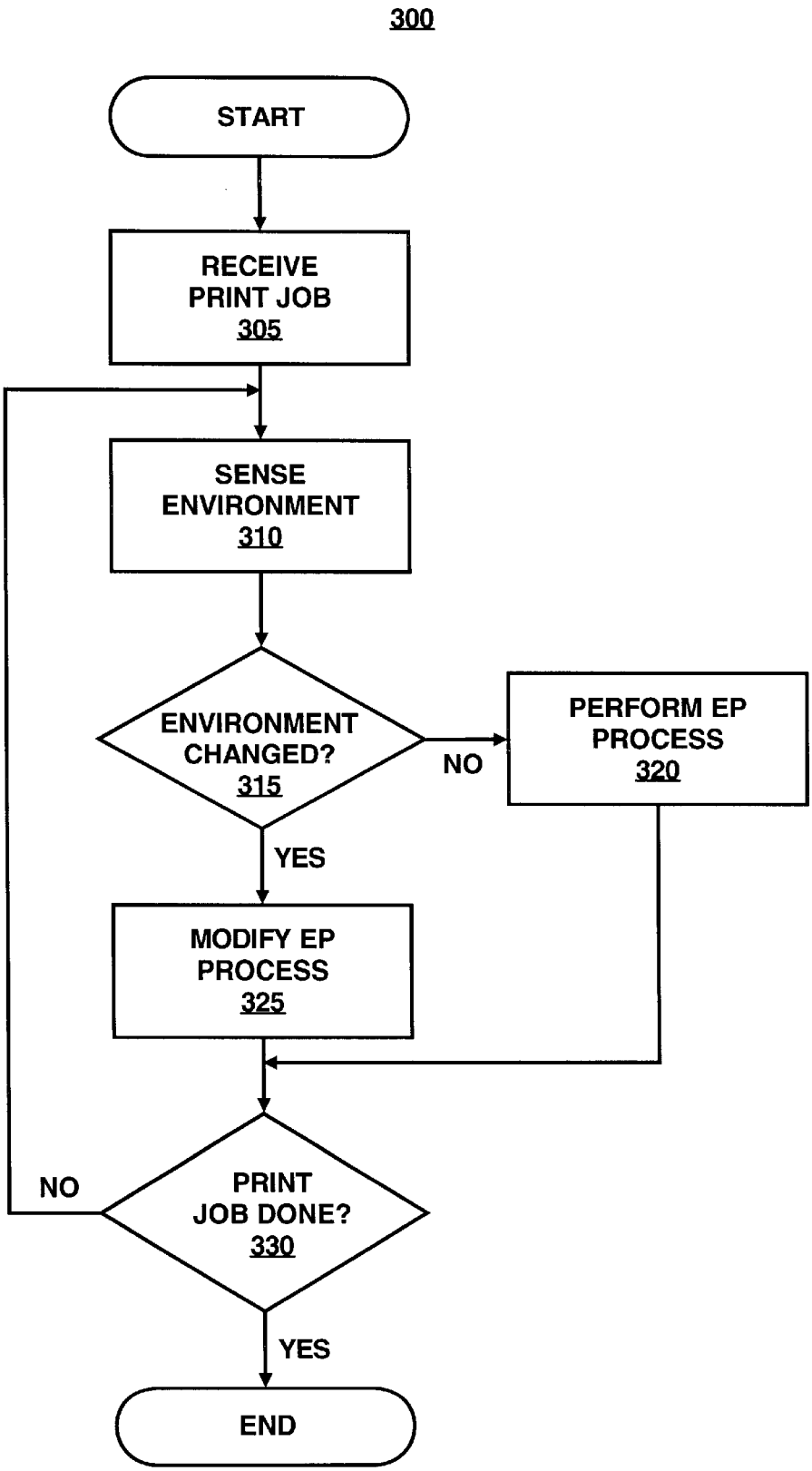
FIG. 3 is a flow chart of a method according to another embodiment of the invention.

FIG. 3 is a flow chart of a method 300 according to another embodiment of the invention. The method 300 is similar to the method 200 described above and thus only those features which are reasonably necessary for a complete understanding of the method 300 are described below. As depicted in FIG. 3, the method 300 is initiated in response to receiving a print job in step 305.

In step 310, the EC(s) may be measured by the sensor 150 as described with respect to step 215 above.

In step 315, it may be determined if the EC(s) has changed. For example, the EC(s) may be compared to EC(s) previously measured and stored in the memory 125. If it is determined that the EC(s) has not changed, the method 300 may proceed to step 320. If it is determined that the EC(s) has changed, the method 300 may proceed to step 325.

In step 320, the EP process may be performed. As is known to those skilled in the art, the EP process may be modified based on the print job. Additionally, the EP process may be performed utilizing previously measured EC(s). Following step 320, the method 300 may proceed to step 330.

In step 325, the EP process may be modified based on the EC(s). Generally, the modifications pertain to the amount of toner transferred to the print medium. In this regard, a variety of methods may be utilized to control toner transfer. In a preferred form, a laser within a printing device may be modulated to control the pulse width of light utilized to illuminate an optical photoreceptor drum and thus control the amount of toner transferred to the print medium. In another form, a motor operable turn a carriage roller within the printer 100 may be controlled to modify the speed of the print medium moving through the printer 100. In this manner, line weight may be controlled thus improving image quality as well as controlling the amount of toner transfer to the print medium. In yet another form, a bias voltage within a developer of the printing device may be modified to control toner transfer. Modulating the bias voltage of the developer produces a corresponding change in the charge of the toner within the toner cartridge and thus, controls the amount of toner transfer to the print medium. In yet another form, a charge on a print roller within the printing device may be modified to control toner transfer. Modulating the charge on the print roller produces a corresponding change in the amount of toner transfer to the print medium. Additionally, in a printing device having an intermediate transfer belt ("ITB") designed to transfer toner to the print medium such as is present in some conventional color laser printers, the speed of the ITB may be modulated to control the amount of toner transferred to the print medium. Furthermore, it is to be understood that the invention is not limited to the EP process modifications mentioned above, but rather, the invention may include any known or future means of controlling toner transfer. Accordingly, the EP process modifications mentioned above are for illustrative purposes only and thus are not meant to limit the invention in any respect.

In step 330, it may be determined if the method 300 has reached the end of the print job or the corresponding printer specific commands generated in response to the print job. For example, if an end of file marker is encountered, the method 300 may terminate. If it is determined that the end of the print job or the corresponding printer specific commands generated in response to the printjob has not been reached, the method 300 may return to step 310.

The methods 200 and 300 may exist in a variety of forms both active and inactive. For example, they may exist as software program(s) comprised of program instructions in source code, object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program may be configured to access, including signals downloaded through the Internet or other networks. Concrete examples of the foregoing include distribution of the program(s) on a CD ROM or via Internet download. In a sense, the Internet itself, as an abstract entity, is a computer readable medium. The same is true of computer networks in general.

Figure 4:
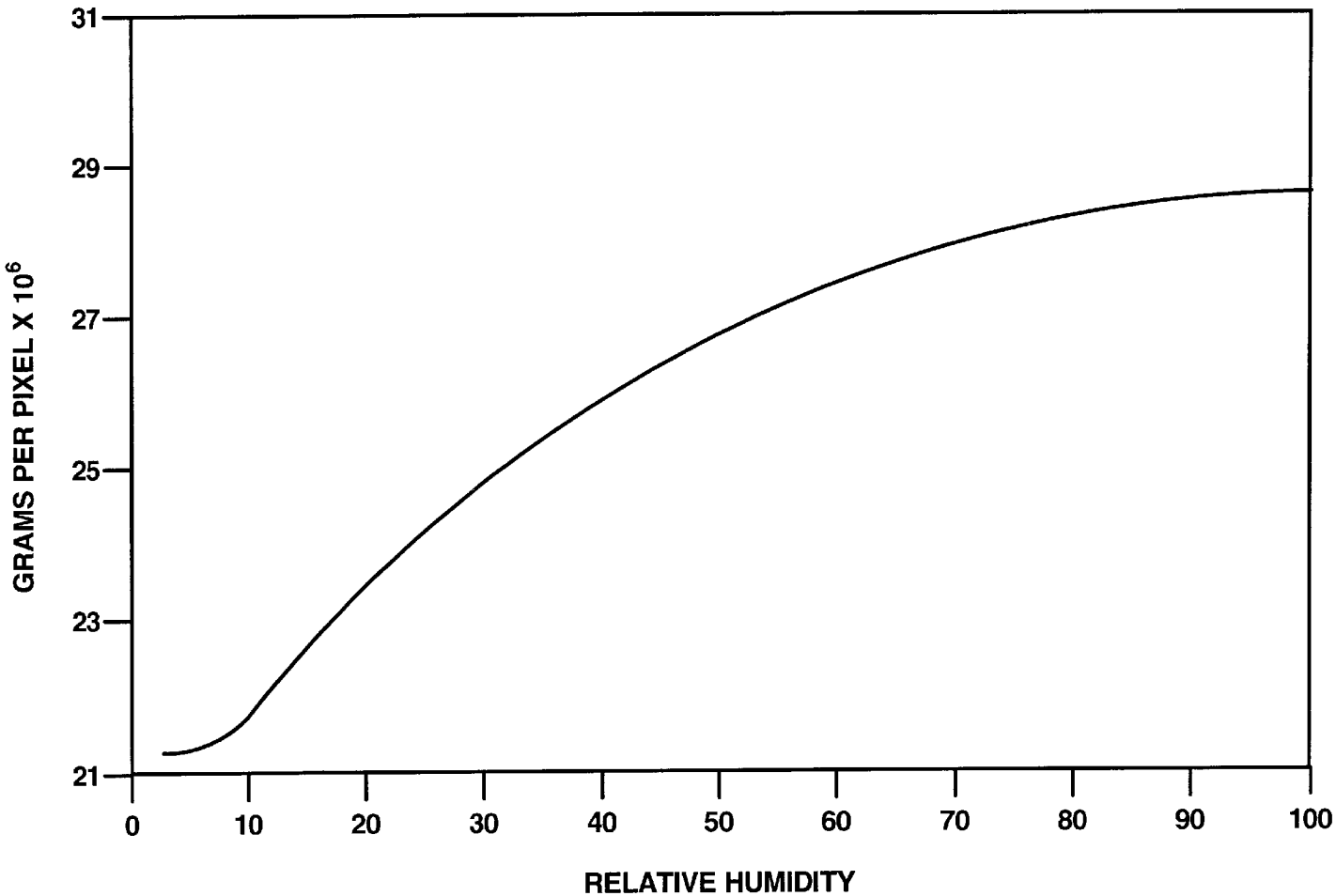
FIG. 4 is an exemplary graph in accordance with an embodiment of the invention described in FIG. 2 of relative humidity (abscissa) as it affects the weight, in grams, of $10^6$ pixels (ordinate).

FIG. 4 is an exemplary graph in accordance with an embodiment of the invention described in FIG. 2 of RH (abscissa) as it affects the weight, in grams, of $10^6$ pixels (ordinate). As shown in FIG. 4, the non-linear effect of RH on toner transfer may be plotted in terms of weight of toner transferred to the printing media is non-linear. In general, toner transfer is shown to increase as RH increases. Thus, in terms of toner usage per pixel, a correction factor based on a function of the curve may be used to adjust the toner usage. For example, a statistical regression equation based on the function of the curve may be utilized to determine toner usage based on a pixel count and the RH.

Additionally, it is to be understood that the invention is not limited to a function of the graph illustrated in FIG. 4, but rather, the invention may include any reasonable function correlating toner usage to any EC that may affect toner usage. Accordingly, the graph depicted in FIG. 4 is for illustrative purposes only and thus is not meant to limit the present invention in any respect.

Moreover, the correction factor is determined based upon system design, empirically determined data, etc. In general, the correction factor may depend upon one or more of the following factors: system application, laser specifications, printer head specifications, toner or ink characteristics, OPR parameters, accuracy of the system, ECs, etc.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method comprising:

receiving an environmental condition measurement via a network;

modifying a printing process in response to the received environmental condition measurement, wherein the printing process comprises modulating a laser;

receiving a print job;

determining a set of instructions for the laser in response to the print job;

correcting the set of instructions for the laser in response to the environmental condition measurement; and modifying the modulation of the laser according to the corrected set of instructions.

2. The method according to claim 1, wherein the printing process comprises controlling a line weight and the method further comprises:

determining a set of instructions for a carriage roller in response to the print job; and correcting the set of instructions for the carriage roller in response to the environmental condition measurement; and modifying the line weight based on at least one of the corrected set of instruction for the laser and the corrected set of instruction for the carriage roller.

3. A computer readable medium on which is embedded computer software, the software comprising executable code for performing a method, the method comprising:

receiving an environmental condition measurement via a network; and modifying a printing process in response to the received environmental condition measurement, wherein the printing process comprises modulating a laser;

receiving a print job;

determining a set of instructions for the laser in response to the print job;

correcting the set of instructions for the laser in response to the environmental condition measurement; and modifying the modulation of the laser according to the corrected set of instructions.

4. The computer readable medium according to claim 3, wherein the printing process comprises controlling a line weight and the method further comprises:

determining a set of instructions for a carriage roller in response to the print job; and correcting the set of instructions for the carriage roller in response to the environmental condition measurement; and modifying the line weight based on at least one of the corrected set of instruction for the laser and the corrected set of instruction for the carriage roller.

5. An apparatus comprising:

a printing device configured to apply a colorant to a print medium; and a controller configured to modify the printing device based on an environmental condition measurement received via a network.

6. The apparatus according to claim 5, further comprising a memory configured to store data associated with the environmental condition measurement.

7. The apparatus according to claim 6, wherein the controller is further configured to access the memory and reference the data associated with the environmental condition measurement.

8. The apparatus according to claim 5, further comprising:

a user interface configured to provide a user the capability to select a print mode, wherein the controller is further configured to modify the printing device based on the selected print mode.

9. The apparatus according to claim 5, wherein the environmental condition measurement is associated with one or more of the temperature, the relative humidity, and the barometric pressure.

10. The apparatus according to claim 5, wherein the controller is further configured to:

determine a pixel count for a print job; and calculate a toner usage based on the pixel count and the environmental condition measurement.

11. The apparatus according to claim 5, wherein the printing device includes a laser and the controller being further configured to control the laser in response to the environmental condition measurement.

12. The apparatus according to claim 11, wherein the printing device includes a carriage roller configured to move the print medium and the controller being further configured to control a line weight of the colorant on the print medium by at least one of controlling the carriage roller and modulating the laser in response to the environmental condition measurement.

* * * * *